US005342035A

United States Patent [19]

Sugiyama et al.

[11] Patent Number: 5,342,035

[45] Date of Patent: Aug. 30, 1994

[54] PAPER FEED APPARATUS FOR SHEET-FED PRESS

[75] Inventors: Hiroyuki Sugiyama; Tetsuya Takeuchi, both of Ibaragi, Japan

[73] Assignee: Komori Corporation, Tokyo, Japan

[21] Appl. No.: 53,145

[22] Filed: Apr. 27, 1993

[30] Foreign Application Priority Data

May 8, 1992 [JP] Japan ..... 4-142067

[51] Int. Cl.[5] ..... B65H 5/08

[52] U.S. Cl. ..... 271/11; 271/12

[58] Field of Search ..... 271/5, 11, 12, 107, 271/108, 94; 414/797

[56] References Cited

U.S. PATENT DOCUMENTS

| | | | |
|---|---|---|---|
| 1,853,781 | 4/1932 | Rider | 271/12 |
| 1,920,388 | 8/1933 | Harrold | 271/5 |
| 2,084,065 | 6/1937 | Reinwartz | 271/5 |
| 2,185,652 | 1/1940 | Spiess . | |
| 2,201,604 | 5/1940 | Backhouse . | |
| 2,693,957 | 11/1954 | Welsh | 271/12 |
| 3,261,601 | 7/1966 | Schwebel | 271/11 |
| 3,980,292 | 9/1976 | Saburai | 271/11 |
| 4,129,294 | 12/1978 | Marass | 271/107 |
| 5,052,672 | 10/1991 | Horii | 271/11 |

FOREIGN PATENT DOCUMENTS

| | | | |
|---|---|---|---|
| 2500222 | 3/1976 | Fed. Rep. of Germany . | |
| 2254435 | 7/1975 | France . | |
| 45-12928 | 5/1970 | Japan . | |
| 0023126 | 1/1990 | Japan | 271/107 |

*Primary Examiner*—H. Grant Skaggs

*Attorney, Agent, or Firm*—Blakely, Sokoloff, Taylor & Zafman

[57] ABSTRACT

A paper feed apparatus for a sheet-fed press includes a paper stack unit, a suction port member, a cam mechanism, and a paper feed roller and a paper feed roll. The paper stack unit stacks paper sheets on a paper stack plate thereof. The suction port member draws the leading end portion of the paper sheet stacked on the paper stack unit. The cam mechanism moves the suction port member vertically between a suction position and an upper position and back and forth between the suction position and a retreat position. The paper feed roller and the paper feed roll are disposed within the forward path of the suction port member, and draw the paper sheet conveyed by the suction port member and feed the paper sheet onto a feeder board.

3 Claims, 4 Drawing Sheets

PAPER FEED APPARATUS FOR SHEET-FED PRESS

BACKGROUND OF THE INVENTION

The present invention relates to a paper feed apparatus for a sheet-fed press, which draws a paper sheet stacked on the paper stack plate of a paper stack table, grips the leading end portion of the paper sheet with a paper convey member, and feeds the paper sheet onto a feeder board to perform printing.

A paper feed apparatus provided to a sheet-fed press has a paper stack table for supporting a paper stack plate on which paper sheets are stacked. A plate-like feeder board is inclinedly supported in front of the paper stack table such that its front portion is lower than its rear portion. A suction port member that can move vertically and back and forward is provided above the stacked paper sheet. A paper feed roller to be rotated by a driving unit and a paper feed roll opposing the upper circumferential surface of the paper feed roller are provided between the paper stack table and the feeder board.

With this arrangement, paper sheets stacked on the paper stack plate on the paper stack table are drawn one by one from the highest one by the suction port member, and the drawn paper sheet is moved forward. The moved paper sheet is gripped by the paper feed roller and the paper feed roll at its leading end portion, and is fed onto the feeder board as the paper feed roller and the paper feed roll are rotated.

According to the conventional paper feed apparatus having the above arrangement, however, paper sheets are continuously fed onto the feeder board by inserting a paper sheet under a previously fed paper sheet with a slight shift in the feed direction. Therefore, the trailing end portion of the paper sheet which is exposed from the trailing end portion of the previously fed paper sheet must be drawn by the suction port member. Then, when the paper sheet is to be drawn, the paper sheet portion except for the trailing end portion is not held, resulting in an unstable paper feed operation.

For example, Japanese Patent Publication No. 45-12928 discloses an arrangement in which the leading end portion of a paper sheet is drawn by a suction port member. This arrangement will be described. More specifically, this paper feed apparatus has a feed roller, a guide arm, a suction port member, and a guide plate. The feed roller is axially supported above the leading end portion of the stacked paper sheet and rotated by a motor. The guide arm is supported by a link mechanism and moved forward and backward in the horizontal direction so as to enter from the front side to bring the roll at its distal end portion into contact with the lower circumferential surface of the feed roller and to be retreated forward from the entered state. The suction port member is supported by the link mechanism and moved in the vertical direction with respect to the leading end face of the paper sheet to draw the paper sheet. The guide plate is supported above the reciprocal path of the guide arm. A paper feed roller and a paper feed roll that oppose each other in the vertical direction, and a feeder board, three of which are similar to those described above, are provided in front of the guide plate.

With this arrangement, when a paper feed operation is to be performed, first, the suction port member is moved downward from the upper stop position, draws the leading end portion of the paper sheet, and is then moved upward to the upper stop position, and releases the paper sheet. Simultaneously, the guide arm enters below the feed roller, and the roll at the distal end portion of the guide arm is brought into contact with the lower circumferential surface of the feed roller. The released paper sheet is clamped by the feed roller and the roll. When the feed roller and the roll are rotated, the clamped paper sheet is fed forward on the guide plate, gripped by the paper feed roller and the paper feed roll, and fed onto the feeder board.

According to the conventional paper feed apparatus having the above arrangement, as described above, when the suction port member that has drawn the paper sheet is moved upward and releases the paper sheet, the paper sheet is fed to a portion below the suction port member by the rotation of the feed roller and the roll. At this time, after the paper sheet drawing by the suction port member is released, it is quickly moved in the paper convey direction from the stop state. Then, the paper sheet which is being quickly moved forward and the suction port member may undesirably interfere with each other. It is, however, difficult to set the timing so as not to cause this interference. Hence, high-speed printing cannot be achieved. Furthermore, it is difficult to move all the feed rollers and the rolls simultaneously and to cause them to grip the paper sheet at the same contact pressure. Therefore, a paper feed error such as erroneous paper direction tends to occur to increase waste paper.

SUMMARY OF THE INVENTION

It is an object of the present invention to provide a paper feed apparatus for a sheet-fed press, which increases a printing speed.

It is another object of the present invention to provide a paper feed apparatus for a sheet-fed press, in which a paper feed error is prevented to stabilize a paper feed operation.

In order to achieve the above objects, according to the present invention, there is provided a paper feed apparatus for a sheet-fed press, comprising a paper stack unit for stacking paper sheets on a paper stack plate thereof, a suction port member for drawing a leading end portion of the paper sheet stacked on the paper stack unit, driving means for moving the suction port member vertically between a suction position and an upper position and back and forth between the suction position and a retreat position, and paper convey means, disposed within a forward path of the suction port member, for drawing the paper sheet conveyed by the suction port member and feeding the paper sheet onto a feeder board.

DESCRIPTION OF THE PREFERRED EMBODIMENTS

Figure 1:
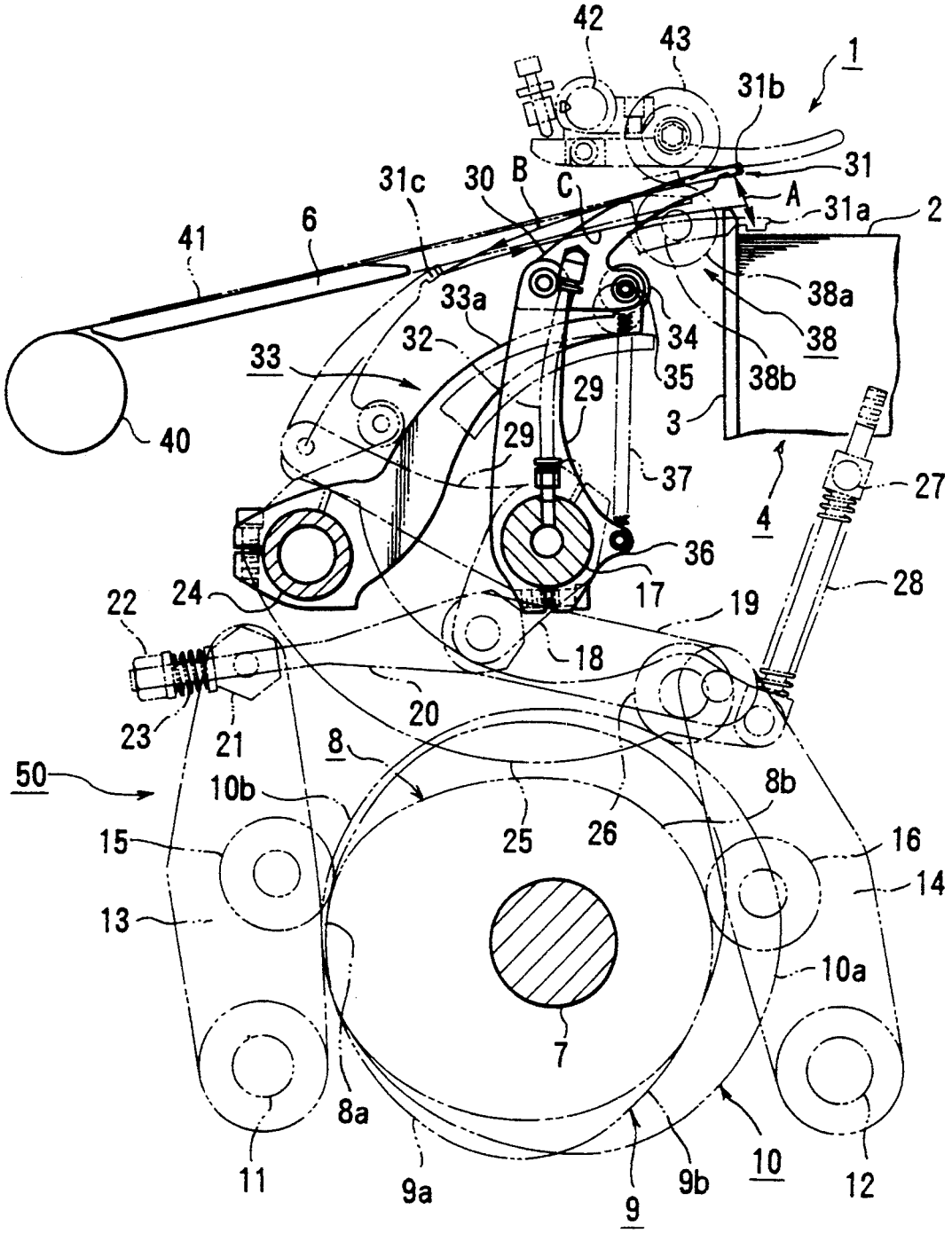
FIG. 1 is a side view showing a paper feed apparatus for a sheet-fed press according to an embodiment of the present invention.
Figure 2:
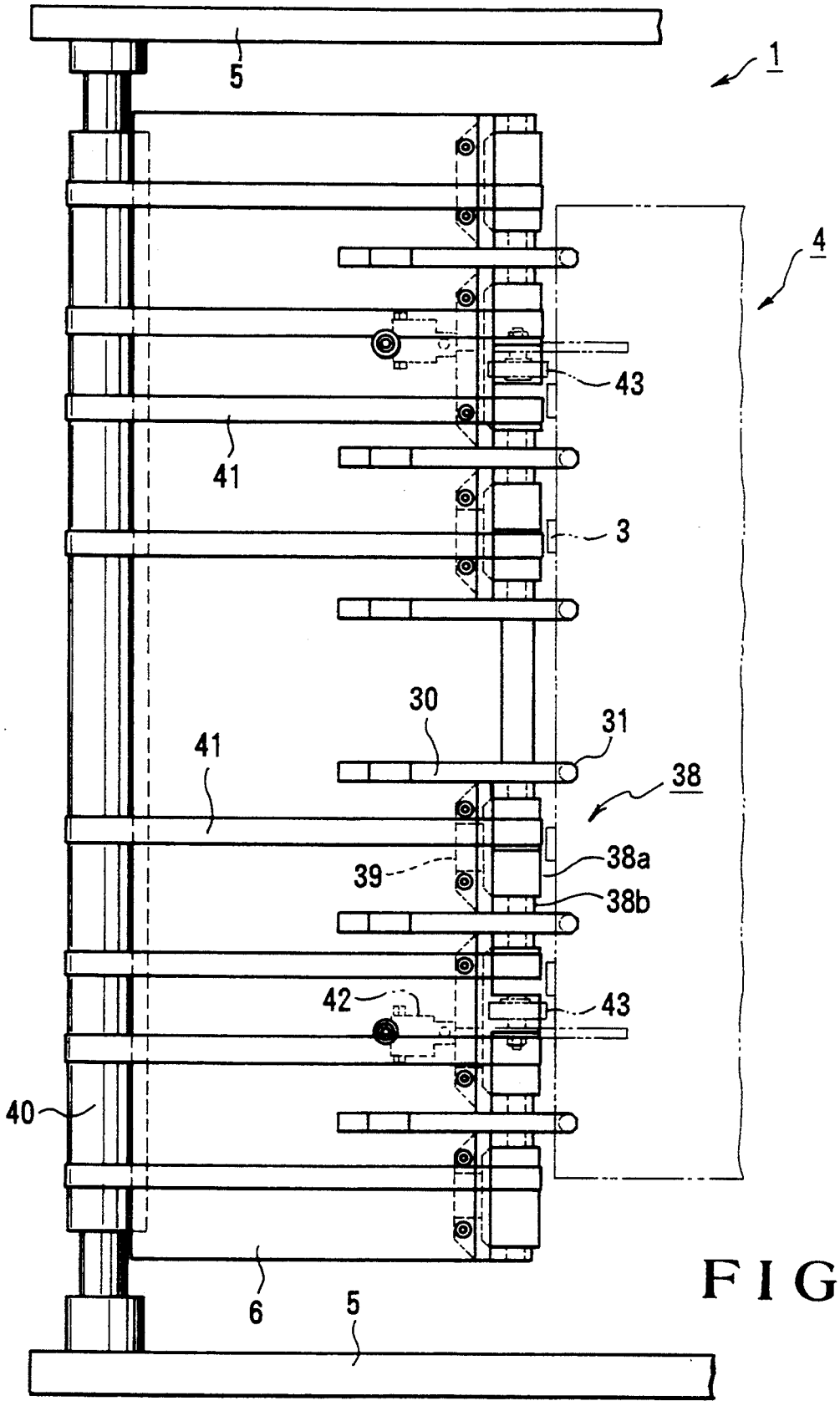
FIG. 2 is a plan view showing the paper feed apparatus for the sheet-fed press according to the embodiment of the present invention.
Figure 3:
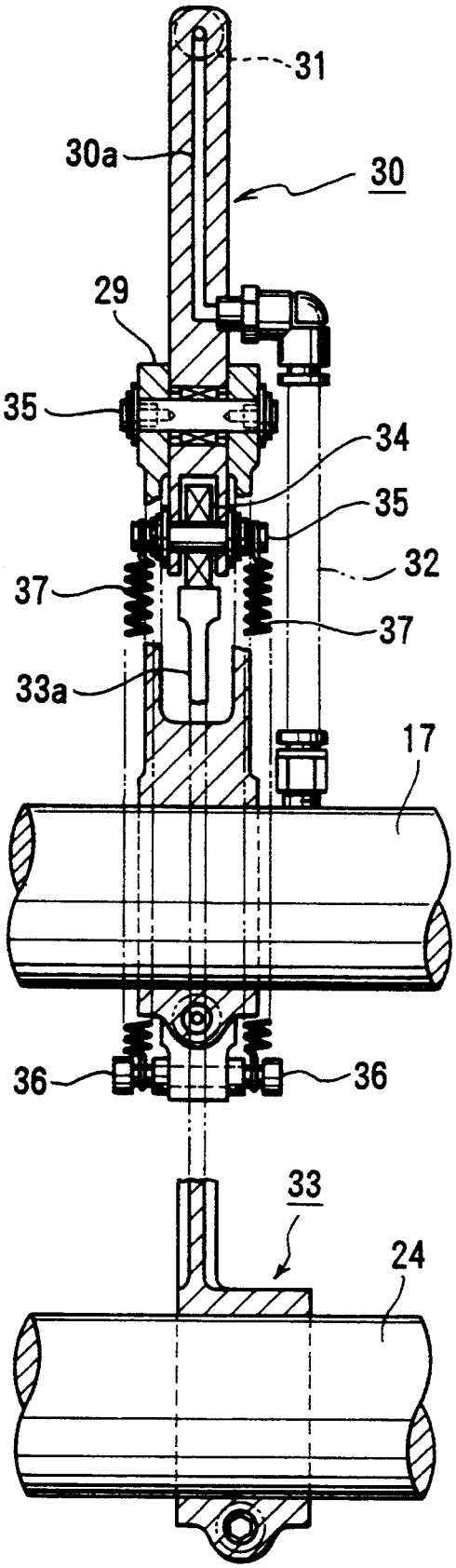
FIG. 3 is a partially developed front view showing the paper feed apparatus for the sheet-fed press according to the embodiment of the present invention.

FIGS. 1 to 3 show a paper feed apparatus for a sheet-fed press according to an embodiment of the present invention. Referring to FIGS. 1 to 3, a paper feed apparatus 1 has a paper stack unit 4 comprising a paper stack table (not shown), a front gauge 3, and the like. The paper stack table is suspended by a vertical chain to be vertically movable. The front gauge 3 abuts against the leading ends of paper sheets 2 stacked on the paper stack table through a paper stack plate, thereby aligning the paper sheets. A plate-like feeder board 6 is provided in front of the upper end portion of the paper stack unit 4. The feeder board 6 is inclined toward its front end, and the two end portions of the feeder board 6 are supported by frames 5.

A cam mechanism 50 serving as a driving means to move suction ports 31 (to be described later) in the vertical direction and the forward-and-backward direction is provided below the feeder board 6. The cam mechanism 50 has a cam shaft 7 located below the feeder board 6, having two end portions axially supported by the frames 5, and driven by a motor. A pair of first back-and-forth driving cams 8 each having a cam surface comprising large- and small-diameter portions 8*a* and 8*b*, a pair of second back-and-forth driving cams 9 each having a cam surface comprising large- and small-diameter portions 9*a* and 9*b*, and a pair of vertical driving cams 10 each having a cam surface comprising large- and small-diameter portions 10*a* and 10*b* are fixed on the cam shaft 7 to be close to the corresponding frames 5. Lever shafts 11 and 12 with rolls are pivotally axially supported by the frames 5 on the two sides to extend in front of and behind the cam shaft 7. Levers 13 and 14 with rolls are fixed to the lever shafts 11 and 12, respectively. Rolls 15 and 16 pivotally mounted on the levers 13 and 14, respectively, oppose the two first back-and-forth driving cams 8 and the two second back-and-forth driving cams 9, respectively.

A lever shaft 17 extends above the cam shaft 7 as it is pivotally axially supported by the frames 5 on the two sides. Levers 18 are fixed on the lever shaft 17 by split clamping. The free end portions of the levers 18 is coupled to the free end portions of the lever 14 by coupling levers 19 each having the two ends pivotally mounted on the free and portions of the corresponding lever 18 and the lever 14. The other end of each rod 20 having one end pivotally mounted on the corresponding lever 18 is slidably inserted in the rod hole of a stud 21 pivotally mounted on the free end portion of the corresponding lever 13. Belleville springs 23 for pressing the rolls 15 and 16 against the back-and-forth driving cams 8 and 9 on the two sides are interposed between the studs 21 and nuts 22 threadably engaged with the distal end portions of the rods 20.

Reference numeral 24 denotes a tubular lever shaft 24 with a roll pivotally axially supported on the frames 5 on the two sides to be in parallel to the lever shaft 17. Levers 25 with rolls are fixed on the lever shaft 24 by split clamping. Rolls 26 pivotally mounted on the free end portions of the levers 25 oppose the cam surfaces of the vertical driving cams 10. The rolls 26 are pressed against the cam surfaces of the vertical driving cams 10 by compression coil springs 28 interposed between the levers 25 and studs 27 of the frames 5.

As shown in FIG. 3, a plurality of operation levers 29 are fixed on the lever shaft 17 by split clamping in an aligned state. An L-shaped suction port arm 30 is pivotally mounted on the free end portion of each operation lever 29, and a suction port member 31 is fixed on one free end portion of each suction port arm 30. The lever shaft 17 has a tubular shape, and its inner hole is connected to a suction air source through a hose (not shown). The inner hole of the lever shaft 17 and air paths 30*a* formed in the suction port arms 30 are connected by flexible hoses 32. The air paths 30*a* of the suction port arms 30 are open in the lower end suction surfaces of the suction port members 31.

Cam levers 33 having arcuated cam surfaces 33*a* on their upper surfaces are fixed on the lever shafts 24 by split clamping. A roll 34 pivotally mounted on the other free end portion of each suction port arm 30 opposes the cam surface 33*a* of the corresponding cam lever 33. Tension springs 37 for bringing the corresponding roll 34 into contact with the cam surface 33*a* extend between the two end portions of a pivot shaft 35 on which this roll 34 is pivotally mounted, and spring grips 36 provided to the pivotal support portion of each operation lever 29. With this arrangement, when the levers 13, 14, and 25 are swung at predetermined timings by the operations of the cams 8, 9, and 10, the suction port members 31 draw the leading end portion of the paper sheet 2 at a suction position 31*a* shown in FIG. 1, are moved to an upper position 31*b* along a track indicated by an arrow A in FIG. 1, are moved to a retreat position 31*c* along a track indicated by an arrow B in FIG. 1, and are returned to the suction position 31*a* along a track indicated by an arrow C in FIG. 1.

Within the moving path of the suction port members 31 extending from the upper position 31*b* toward the retreat position 31*c*, a plurality of paper feed rollers 38 serving as a paper convey means and comprising a plurality of large-diameter roller portions 38*a* and a plurality of small-diameter end shafts 38*b* are axially rotatably supported by U-shaped holders 39 shown in FIG. 2. Paper feed tapes 41 extend between the paper feed rollers 38 and a tape roller 40 axially extending in front of the distal end of the feeder board 6. The paper feed rollers 38 are rotated by the tape roller 40 through the paper feed tapes 41. Furthermore, paper feed rolls 43 axially rotatably supported by holders 42 of the frames 5 are disposed above the two paper feed rollers 38, in this embodiment, of the plurality of paper feed rollers 38, and the paper feed rolls 43 are pressed against the circumferential surfaces of the paper feed rollers 38. The paper sheet 2, which is drawn by the suction port members 31 and being moved forward, is released while it is moving forward, gripped by the paper feed rollers 38 and the paper feed rolls 43, fed onto the feeder board 6, and conveyed by the paper feed tapes 41 and rollers and brushes (not shown).

The operation of the paper feed apparatus having the above arrangement will be described. The paper sheets 2 are stacked on the paper stack plate of the paper stack unit, and the cam shaft 7 is rotated clockwise to start the printing operation. Then, the large-diameter portions 9*a* of the second back-and-forth driving cams 9 are brought into contact with the rolls 15 and the small-diameter portions 8*b* of the first back-and-forth driving cams 8 are brought into contact with the rolls 16, so that the suction port members 31 of the suction port arms 30 located at the retreat position 31*c* in FIG. 1 are moved in the direction of the arrow C through the rods 20, the levers 18, and the operation levers 29. When the rolls 26 of the levers 25 are brought into contact with the small-diameter portions 10*b* of the vertical driving cams 10 while the suction port members 31 are being moved in the direction of the arrow C, the levers 25 are pivoted clockwise in FIG. 1 by the biasing forces of the compression coil springs 28. As the levers 25 are pivoted, the cam levers 33 are pivoted clockwise in FIG. 1 through the lever shaft 24. Then, the suction port arms 30 are pivoted clockwise in FIG. 1 while moving the rolls 34, by the tensile forces of the tension springs 37, to follow the cam levers 33, so that the suction port members 31 are moved to the suction position 31*a* where they are pressed against the leading end portion of the paper sheet 2. At this time, since suction air acts on the suction port members 31, the leading end portion of the paper sheet 2 is drawn by the suction port members 31.

In this state, the large-diameter portions 10*a* of the vertical driving cams 10 oppose the rolls 26, and the levers 25 are pivoted counterclockwise in FIG. 1. Then, the cam levers 33 are pivoted counterclockwise against the tensile forces of the tension springs 37, and the suction port arms 30 are pivoted in the direction of the arrow A while they draw the paper sheet 2 with their suction port members 31, so that the suction port members 31 are moved to the upper position 31*b*. Subsequently, the large-diameter portions 8*a* of the first back-and-forth driving cams 8 are brought into contact with the rolls 16, and the small-diameter portions 9*b* of the second back-and-forth driving cams 9 are brought into contact with the rolls 15, so that the levers 14 and 15 are pivoted clockwise in FIG. 1 about the lever shafts 11 and 12, respectively. Then, the levers 18 are pivoted counterclockwise through the rods 20, and the operation levers 29 are also pivoted counterclockwise, thereby moving the suction port arms 30 in the direction of the arrow B to return the suction port members 31 to the retreat position 31*c*.

When the suction port members 31 are moved from the upper position 31*b* to the retreat position 31*c* in FIG. 1, supply of the suction air to the suction port members 31 is stopped in the initial period of the movement, and the paper sheet 2 is released. Simultaneously, the paper sheet 2 is gripped by the paper feed rollers 38 and the paper feed rolls 43 that are rotating, and fed onto the feeder board 6. The speed of the paper sheet 2 being gripped is almost the same as the peripheral velocity of the paper feed rollers 38. Thereafter, the paper sheet 2 is conveyed by the paper feed tapes 41 and the rolls and brushes (not shown), and supplied to the printing unit. In the last period of the movement of the suction port members 31, the suction port members 31 are moved below the convey path of the paper sheet 2 in order to avoid interference with the paper sheet 2.

Figure 4:
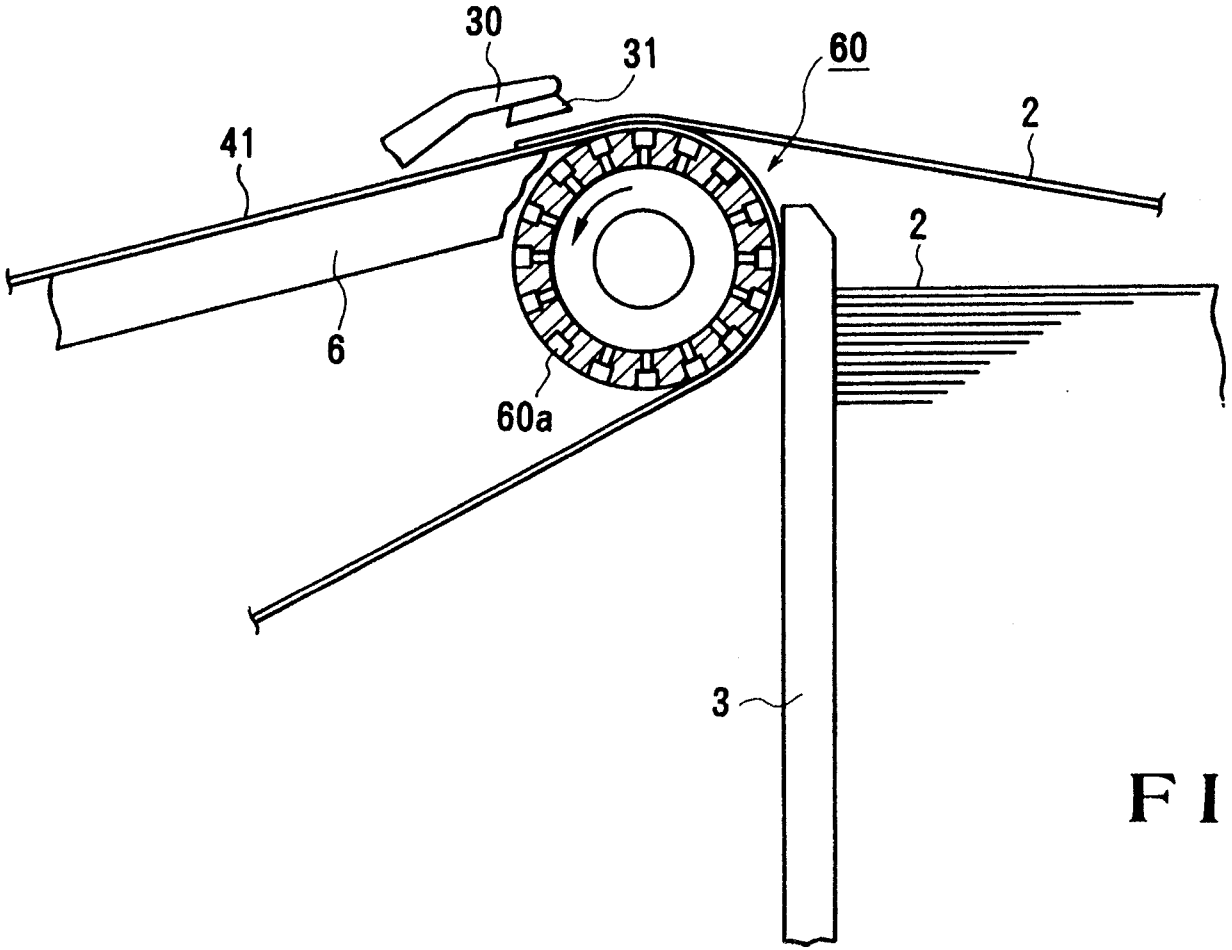
FIG. 4 is a side view showing a portion near a paper convey member of a paper feed apparatus for a sheet-fed press according to another embodiment of the present invention.

FIG. 4 is a side view showing a portion near a paper convey member of a paper feed apparatus according to another embodiment of the present invention. Members having the same arrangements as those in FIG. 1 are denoted by the same reference numerals, and a detailed description thereof will be omitted. In this embodiment, in place of the paper feed rollers 38 and the paper feed rolls 43 shown in FIG. 1, only suction wheels 60 are used to serve as the paper convey member that grips a paper sheet 2, drawn by suction port members 31 and moved, and feeds the paper sheet 2 onto a feeder board 6. More specifically, the plurality of suction wheels 60, each of which has a plurality of suction holes 60*a* formed therein to communicate with a suction air source and around which paper feed tapes 41 are applied, are disposed parallel to each other at positions, between the front end of the feeder board 6 and a front gauge 3, corresponding to the paper feed rollers 38. The suction wheels 60 are rotated by a motor in a direction indicated by an arrow in FIG. 4. With this arrangement, the paper sheet 2 drawn by the suction port members 31 and moved is released from the suction port members 31 above the suction wheels 60, is drawn by the circumferential surfaces of the suction wheels 60 by the operation of the suction air to the suction holes 60*a*, is fed onto the feeder board 6, and is conveyed by the paper feed tapes 41.

In the above embodiments, the paper feed rollers 38 or suction wheels 60, and the paper feed tapes 41 provided to them are indicated as the paper convey means. However, the paper convey means may include only the paper feed tapes 41 or paper feed rollers 38. In the above embodiments, the cam mechanism is indicated as the driving means for moving the suction port members 31 in the vertical direction and the forward-and-backward direction. However, the driving means is not limited to the cam mechanism, and even a driving means other than the cam mechanism can provide the same effect.

As is apparent from the above explanation, according to the present invention, since the paper sheet can be fed onto the feeder board by the suction port members at almost the same speed as the convey speed of the paper convey means, the timing to avoid paper interference can be easily set to enable a stable paper feed operation. Since the suction port members draw the leading end portion of the paper sheet and feed out the paper sheet, the paper sheet can be smoothly fed to further stabilize the paper feed operation, and the waste paper is decreased. Since a sucker box which is conventionally used is not needed, the operability of the paper stacking operation and the like is improved. Since only the suction wheels are used as the paper convey member that conveys the paper sheet released from suction, the paper sheet being conveyed will not be pressed by the paper feed rolls or the like, so that damage or rubbing-off of the paper sheet can be minimized, thereby decreasing the waste paper.

What is claimed is:

1. A paper feed apparatus for a sheet-fed press, comprising:

a paper stack unit for stacking paper sheets on a paper stack plate thereof;

a suction port member for drawing a leading end portion of a paper sheet stacked on said paper stack unit, said suction port member being movable between a suction position at which the leading edge portion of the paper sheet is engaged on said stack, an upper position above the suction position and a retreat position before the suction position and after the upper position in a paper feeding direction of the paper sheet, the traveling path of the suction port member from the retreat position to the suction position disposed at the position lower than that from the upper position to the retreat position, and at a portion lower than the sheet transport path of the paper convey means;

driving means for moving said suction port member cyclically from the retreat position to the suction position, and then to the upper position in that order; and paper convey means, disposed within a forward path of said suction port member, for drawing the paper sheet released by said suction port member and feeding the paper sheet in the paper feeding direction, a convey speed of said paper convey means being substantially the same as a moving speed of said suction port member from the upper position to the retreat position, wherein said suction port member draws the paper sheet at the suction position subsequently releases the paper sheet drawn at the initial period of a movement thereof from the upper position to the retreat position to transfer the paper sheet released to said paper convey means, and subsequently retreats downward from a paper convey path of the paper sheet in a last period of the movement thereof from the upper position to the retreat position.

2. An apparatus according to claim 1, wherein said driving means comprises a cam mechanism having a plurality of cams, and said suction port member is sequentially driven, by a pivot movement of said cams, to move among the retreat position, the suction position, and the upper position.

3. An apparatus according to claim 1, wherein said paper convey means comprising a suction wheel having a plurality of suction holes open to a circumferential surface thereof, and said suction port member releases the paper sheet drawn above said suction wheel to lay the paper sheet on said suction wheel.

* * * * *